US008419562B2

(12) United States Patent
Marrero

(10) Patent No.: US 8,419,562 B2
(45) Date of Patent: Apr. 16, 2013

(54) APPARATUS FOR DECELERATION TRAINING FOR GOLF

(76) Inventor: Hector M. Marrero, Las Vegas, NV (US)

( * ) Notice: Subject to any disclaimer, the term of this patent is extended or adjusted under 35 U.S.C. 154(b) by 0 days.

(21) Appl. No.: 13/221,180

(22) Filed: Aug. 30, 2011

(65) Prior Publication Data

US 2013/0053162 A1 Feb. 28, 2013

(51) Int. Cl.
*A63B 69/36* (2006.01)

(52) U.S. Cl.
USPC ..... 473/256; 473/226

(58) Field of Classification Search ..... 473/219, 473/226, 228, 256, 437, 457
See application file for complete search history.

(56) References Cited

U.S. PATENT DOCUMENTS

| | | | | |
|---|---|---|---|---|
| 2,608,409 | A * | 8/1952 | Pinkerton | 473/256 |
| 4,588,191 | A * | 5/1986 | Stewart | 473/256 |
| 6,612,936 | B1 * | 9/2003 | Matias | 473/256 |
| 7,588,500 | B2 * | 9/2009 | Hoeckl et al. | 473/256 |
| 2002/0128085 | A1 * | 9/2002 | Kallassy | 473/256 |
| 2007/0021228 | A1 * | 1/2007 | Flood | 473/226 |

* cited by examiner

*Primary Examiner* — Nini Legesse

(57) ABSTRACT

An apparatus comprises a structure comprising a top, a bottom, a sidewall, a central hole extending from the top to the bottom, a void in a section of the sidewall, and a curved cavity disposed in the top. The central hole is configured to accept a shaft of a golf club. The void is configured to enable a length of the shaft to pass through the sidewall into the central hole. A compressible material is joined to a wall of the central hole to contact the shaft. A clasp is joined to the structure. The clasp is operable to rotate about the sidewall to close the void and retain the shaft within the central hole. A spring mechanism is disposed in the curved cavity and is joined to the structure and the clasp. The spring mechanism is configured to be operable to urge the clasp to close the void.

4 Claims, 3 Drawing Sheets

APPARATUS FOR DECELERATION TRAINING FOR GOLF

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to sports equipment. More particularly, the invention relates to a device to help practice golf swings.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is believed that deceleration training can help improve a golfer's swing by increasing the strength and velocity of the swing. Deceleration training typically involves swinging a practice club that is heavier than the golfer's game club is, similarly to how a baseball player often places a weight on his bat while warming up. Deceleration training may be useful for loosening the muscles and preparing them for increased force at an increased speed, which may enable those muscles to respond with a more forcible and faster impact immediately after. The greater the net speed and net force of the swing, the farther the ball can travel.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a side perspective view. FIG. 1B is a top perspective view. FIG. 1C is a side perspective view of an end of the weight, and FIG. 1D is a partially transparent top perspective view; FIG. 2A is a top perspective view of the weight in an open position, and FIG. 2B is a top perspective view of the weight in a closed position. FIG. 2C shows a golfer swinging the club with the weight attached.

Figure 1A:
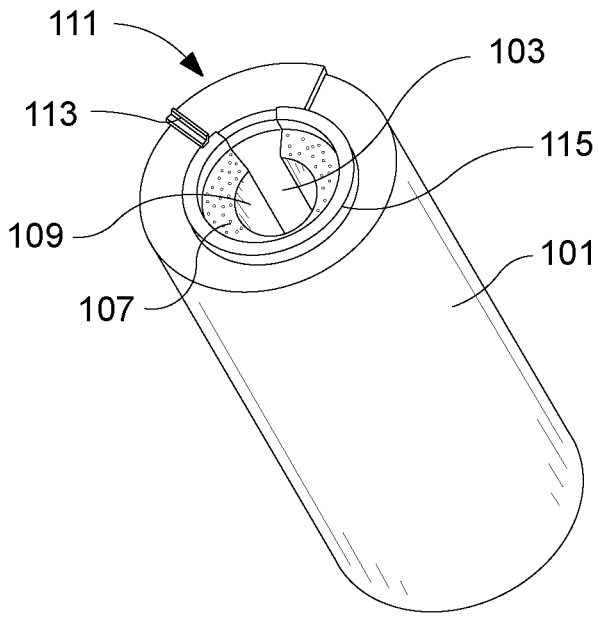
FIGS. 1A through 1D illustrate an exemplary golf club weight, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a variety of apparatus for deceleration training for golf are described.

In one embodiment an apparatus comprises a weighted structure comprising a top, a bottom, a sidewall, a central hole extending from the top to the bottom, and a void in a section of the sidewall. The central hole is configured to accept a shaft of a golf club. The void is configured to enable a length of the shaft to pass through the sidewall into the central hole. A clasp is joined to the weighted structure. The clasp is operable to move about the sidewall to close the void and retain the shaft within the central hole. Another embodiment further comprises a compressible material being joined to a wall of the central hole. Yet another embodiment further comprises a spring mechanism being joined to the weighted structure and the clasp. The spring mechanism being configured to be operable to urge the clasp to close the void. In still another embodiment the clasp further comprises a protrusion being configured to be grasped to move the clasp. In another embodiment the weighted structure further comprises a curved cavity disposed in the top. The curved cavity is configured to retain the spring mechanism. In yet another embodiment the clasp further comprises a curved leg joining the spring mechanism to the clasp. The curved leg is configured to move within the curved cavity. In still another embodiment the clasp further comprises a protrusion disposed on a face of the clasp. The protrusion is configured to mate with an end portion of the curved cavity in a closed position. In another embodiment the weighted structure further comprises a cylindrical shape. In yet another embodiment the void comprises an angular shape. In still another embodiment the compressible material comprises a vinyl coated foam material.

In another embodiment an apparatus comprises a weighted structure comprising a top, a bottom, a sidewall, a central hole extending from the top to the bottom, an angular void in a section of the sidewall, and a curved cavity disposed in the top. The central hole is configured to accept a shaft of a golf club. The angular void is configured to enable a length of the shaft to pass through the sidewall into the central hole. A compressible material is joined to a wall of the central hole to contact the shaft. A clasp is joined to the weighted structure. The clasp is operable to rotate about the sidewall to close the angular void and retain the shaft within the central hole. A spring mechanism is disposed in the curved cavity and is joined to the weighted structure and the clasp. The spring mechanism is configured to be operable to urge the clasp to close the angular void. In another embodiment the clasp further comprises a protrusion being configured to be grasped to move the clasp. In yet another embodiment the clasp further comprises a curved leg joining the spring mechanism to the clasp. The curved leg is configured to move within the curved cavity. In still another embodiment the clasp further comprises a protrusion disposed on a face of the clasp. The protrusion is configured to mate with an end portion of the curved cavity in a closed position. In another embodiment the weighted structure further comprises a cylindrical shape. In yet another embodiment the compressible material comprises a vinyl coated foam material.

In another embodiment an apparatus comprises a weighted structure comprising a top, a bottom, a sidewall, a central hole extending from the top to the bottom, a void having an angular shape and extending from the top to the bottom in the sidewall, a first curved cavity disposed in the top, and a second curved cavity disposed is the bottom. The central hole is configured to accept a shaft of a golf club. The void is configured to enable a length of the shaft to pass through the sidewall into the central hole. A compressible material is joined to a wall of the central hole to contact the shaft. A clasp comprises a surface being configured to cover the void, a face extending into the void, a first a curved leg being configured to move within the first curved cavity, a second a curved leg being configured to move within the second curved cavity, a first protrusion being disposed on the face to mate with an end portion of the first curved cavity and a second protrusion disposed on the face to mate with an end portion of the second curved cavity. The clasp is operable to rotate about the sidewall to close the void and retain the shaft within the central hole. A first spring mechanism is disposed in the first curved cavity and is joined to the weighted structure and the first curved leg. The first spring mechanism is configured to be operable to urge the clasp to close the angular void. A second spring mechanism is disposed in the second curved cavity and is joined to the weighted structure and the second curved leg. The second spring mechanism is configured to be operable to urge the clasp to close the angular void. In another embodiment the clasp further comprises a protrusion being configured to be grasped to rotate the clasp. In yet another embodiment the weighted structure further comprises a cylindrical shape. In still another embodiment the compressible material comprises a vinyl coated foam material.

Other features, advantages, and objects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention provides a device that enables golfers to practice deceleration training with their clubs to help them practice and likely improve their swings. A practical embodiment may comprise a weighted cylindrical column for application upon a golf shaft directly above the hosel, which is the point at which the head of the golf club is attached to the shaft.

Figure 1B:
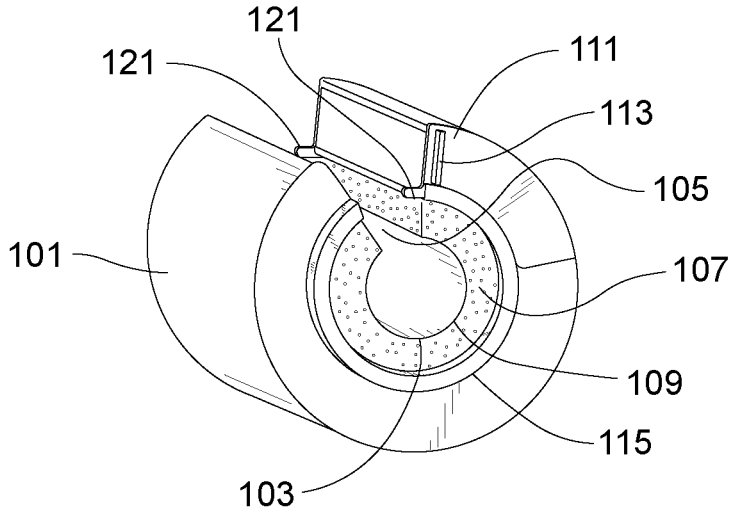
Figure 1C:
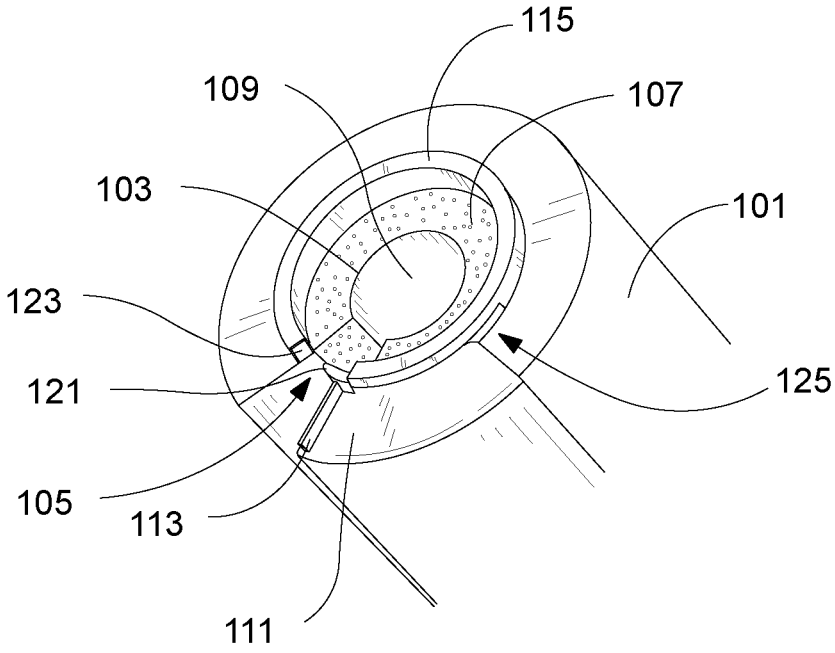
Figure 1D:
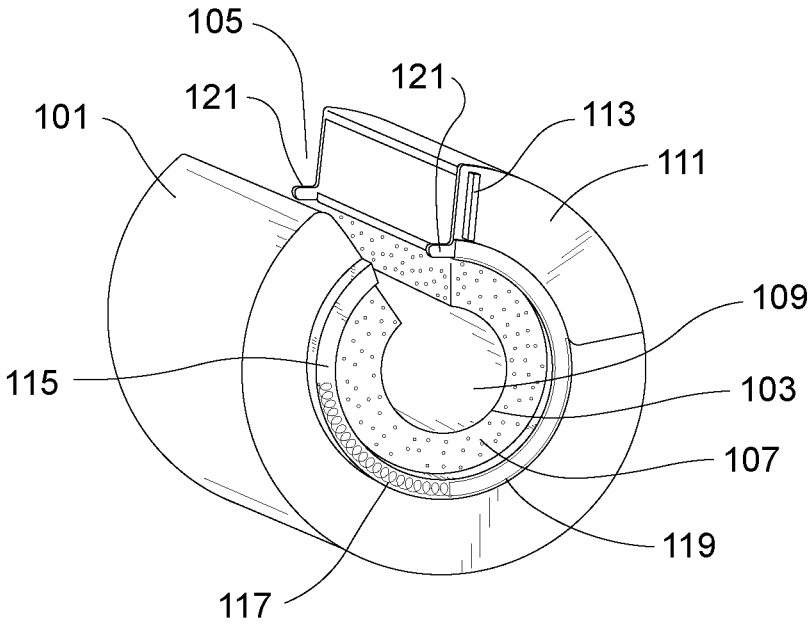

FIGS. 1A through 1D illustrate an exemplary golf club weight, in accordance with an embodiment of the present invention. FIG. 1A is a side perspective view. FIG. 1B is a top perspective view. FIG. 1C is a side perspective view of an end of the weight, and FIG. 1D is a partially transparent top perspective view. In the present embodiment, the weight comprises a weighted column 101 with a centered hole 103, an open angular void 105 in the body of column 101 leading to centered hole 103, a compressible material 107 upon the interior circumference of centered hole 103, a textured lining 109 upon compressible material 107, and a spring-loaded clasp 111 to seal angular void 105 after weighted column 101 is applied upon a golf club. In the present embodiment, column 101 is made of a durable plastic such as, but not limited to, high-density polyethylene (HDPE); however the column in some alternate embodiments can be made of various different materials and/or combination of materials, including but not limited to scandium, carbon fiber, rubber, different plastics, etc. In some alternate embodiments, the weight can feature added interior substances and/or materials for purpose of reaching a desired weight, such as, but not limited to, sand, cement and various metals. In the present embodiment, the golf club weight is approximately one and one-half inch in diameter by four inches in height (1.5"×4"), and the total weight of the golf club weight is approximately one pound (16 oz). However, in some alternate embodiments the weights can be made in different sizes and weights for application upon different club types, such as, but not limited to, woods, irons, putters and hybrids and to accommodate clubs with different shaft flexes, including but not limited to lady, intermediate, regular, stiff and tour stiff shaft flexes.

In the present embodiment, hole 103 extends through the center of column 101 for the entire length of column 101, and has an interior diameter of approximately three hundred and thirty thousandths of an inch (0.330"). However, in some alternate embodiments the holes may be made with different interior diameters for application upon different golf club types directly above the hosel, for example, without limitation, three hundred and thirty-five thousandths of an inch (0.335") for application upon a typical wood or three hundred and seventy hundredths of an inch (0.37") for application upon a typical iron. Some alternate embodiments can also be made in formats to accommodate clubs with other lowest-point diameters, such as but not limited to taper-tipped shaft diameters of three hundred and fifty-five thousandths of an inch (0.355"). In the present embodiment, the interior diameter of hole 103 is lined with compressible material 107 of adequate durability and accommodating compression such as, but not limited to, polypropylene (PP) or expanded polystyrene (EPS) foam. Compressible material 107 is pliable and allows for the accommodation of clubs with different shaft sizes. Textured lining 109 is applied upon compressible material 107 to provide added grip to a golf club inserted into hole 103. Textured lining 109 can be made of various different materials, such as, but not limited to, vinyl or rubber. Some alternate embodiments may be implemented without a textured lining. In the present embodiment, a similar coating may be applied upon the entire exterior body of column 101. This exterior coating can be made of various different materials, such as, but not limited to, vinyl, low-density polyethylene (LDPE), plasticized polyvinyl chloride (p-PVC), etc. Some alternate embodiments may be implemented without an exterior coating.

In the present embodiment, angular void 105 extends from center hole 103 to the exterior arc of column 101 and has an approximate radius of thirty degrees (30°) at the endpoint of the exterior arc; however, voids in some alternate embodiments may be larger or smaller. Angular void 105 extends the entire length of column 101 and forms a slot through which a golf club may be inserted into column 101. The sidewalls of angular void 105 are angled so that void 105 narrows as it progress through the body of the column until it ends within hole 103 to enable a user to easily insert the shaft of a golf club into hole 103. Because angular void 105 is angled, the insertion of the club does not have to be precise and the angle naturally aligns the club with hole 103. Some alternate embodiments may comprise voids with straight sidewalls rather than angled sidewalls.

In the present embodiment, spring-loaded clasp 111 attaches upon column 101 from the interior arc of hole 103 behind compressible material 107. In the present embodiment, spring-loaded clasp 111 is made of high-density polyethylene (HDPE) and has an outermost arc plane of an approximately one half-inch (½") in total length to close angular void 105 upon the exterior arc of column 101 to firmly secure the weight upon a golf club. Some alternate embodiments may comprise clasps that are made of various different materials such as, but not limited to different plastics or various metals. In the present embodiment, a top plane of clasp 111 features a raised ridge 113 of approximately one half-inch in length. Ridge 113 can easily be grasped by a finger of a user to pull clasp 111 into the open position. Each end of column 101 comprises a curved, upward projecting hollow cavity 115. Cavities 115 circle the opening circumference of hole 103 with one end starting at the edge of void 105 and the other end ending at the opposite edge of void 105. Referring to FIG. 1D, clasp 111 is connected to column 101 by two springs 117, one at each end of column 101, which are connected to curved and elongated legs 119 of clasp 111. Legs 119 are housed in and ride back and forth in cavities 115. The interior section of clasp 111 comprises two teeth 121. Referring to FIG. 1C, teeth 121 are inserted into end portions 123 of cavities 115 to generally ensure a solid seal of clasp 111. A slit 125 in cavity 115 enables clasp 111 to move back and forth. In the present embodiment, cavities 115, springs 117 and teeth 121 are located on both ends of column 101; however, in some alternate embodiments, these elements may only be present at one end of the column.

In some alternate embodiments, the spring-loaded clasp may be implemented so that the spring holds the clasp in the open position and some type of locking means such as, but not limited to, snaps or buckles hold the clasp in the closed position. In other alternate embodiments, golf club weights can be made in variations without spring-loaded clasps. For example, without limitation, some alternate embodiments may use various different types of clasps such as, but not limited to, sliding or expandable clasps that lock in the closed position by locking means including, but not limited to, clasps, snaps, hooks, pins, etc. Other alternate embodiments may comprise a multiplicity of suitable means for opening and closing the weight such as, but not limited to, hinging clasps, removable panels, straps, etc. Yet other alternate embodiments may be implemented without opening and closing means in which the material(s) within the interior hole of the device are of great enough frictional resistance to generally ensure the placement of the device upon a golf shaft can tolerate a full swing of the club without displacement of the device.

Figure 2A:
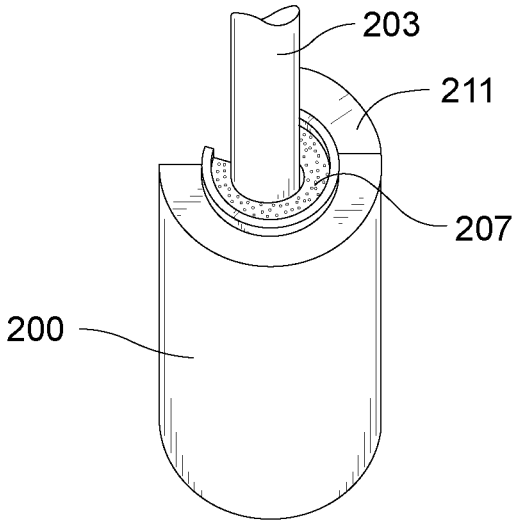
FIGS. 2A through 2C illustrate an exemplary golf club weight in use on a golf club, in accordance with an embodiment of the present invention.
Figure 2B:
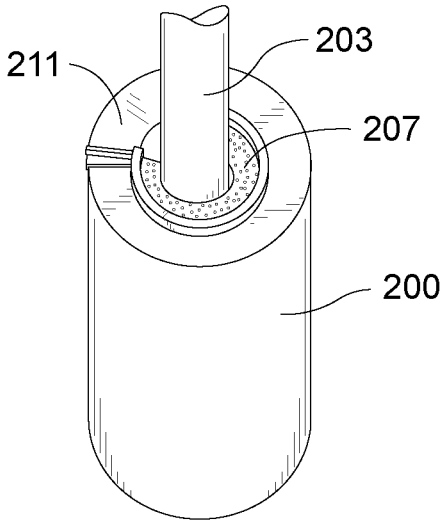
Figure 2C:
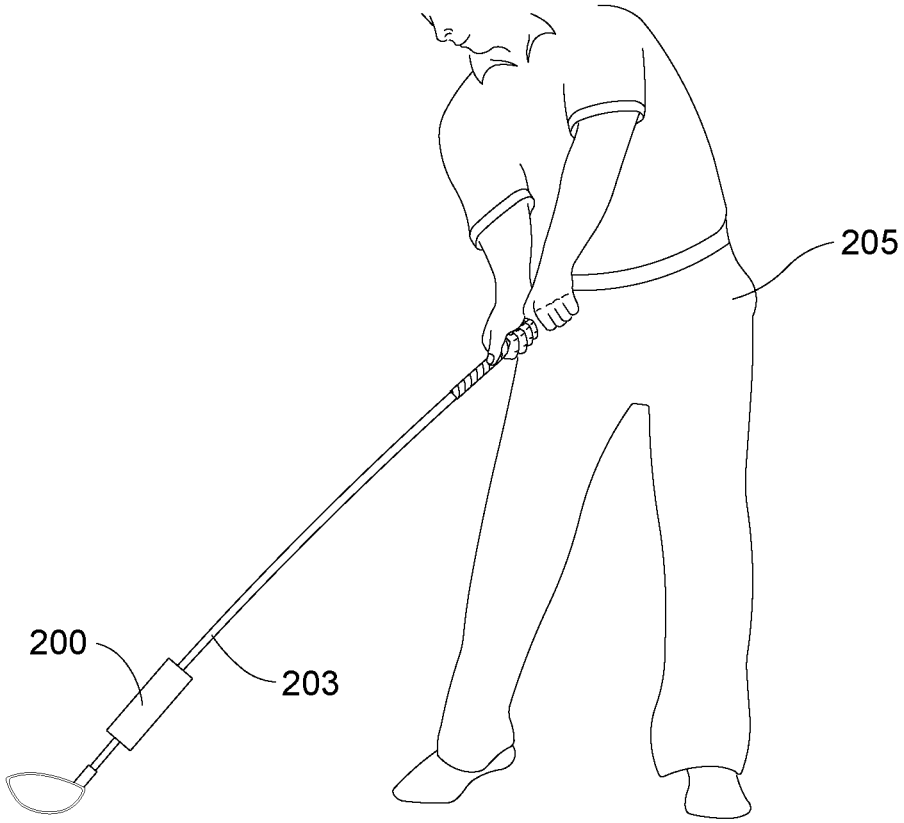

FIGS. 2A through 2C illustrate an exemplary golf club weight 200 in use on a golf club 203, in accordance with an embodiment of the present invention. FIG. 2A is a top perspective view of weight 200 in an open position, and FIG. 2B is a top perspective view of weight 200 in a closed position. FIG. 2C shows a golfer 205 swinging club 203 with weight 200 attached. Weight 200 applies additional weight upon golf club 203 to enable a user to practice weighted swings of golf club 203 and engage in deceleration training. In typical use of the present embodiment, referring to FIGS. 2A and 2B, a user may apply weight 200 upon the desired golf club 203 by sliding a spring-loaded clasp 211 to an open position, inserting weight 200 upon the shaft of club 203 directly above the hosel, and then releasing spring-loaded clasp 211 so that it may return to the closed position and completely encase the shaft of club 203. A compressible material 207 within the interior diameter of weight 200 generally ensures a snug fit upon golf club 203 and typically minimizes the risk of independent motion of weight 200 during practice swings. The addition of a textured lining upon compressible material 207, as illustrated by way of example in FIGS. 1A through 1D, may enhance the fit of weight 200 upon golf club 203. However, some embodiments may be implemented without a textured lining. In the present embodiment, weight 200 can be easily applied upon all types of golf clubs since compressible material 207 can accommodate clubs of different sizes by compressing more or less. Compressible material 207 also generally ensures that no markings or other damage are left upon the shaft of club 203 at its contact point with weight 200 to limit any risk to the structure, appearance or use of golf club 203. Referring to FIG. 2C, golfer 205 may then practice swinging club 203 with the additional weight that weight 200 applies. After taking these practice swings, golfer 205 may retract spring-loaded clasp 211, remove weight 200, and use club 203 in a swing upon a golf ball. Weight 200 can be applied to and removed from golf club 203 easily and quickly and can be used during a regular golf game, typically without imposing any delay upon that game.

It is contemplated that golfer 205 will be able to swing with greater velocity and apply more force upon the golf ball after performing practice swings with weight 200, and may achieve a greater distance in that drive. This increase in speed and velocity may be achieved because weight 200 helps golfer 205 more quickly exert muscle force in his swings after practicing with weight 200. Weight 200 may also help golfer 205 release muscle tension in his shoulders, arms and back. Furthermore, after removing weight 200, it is believed that swinging club 203 without weight 200 will be easier.

Those skilled in the art will readily recognize, in light of and in accordance with the teachings of the present invention, that any of the foregoing steps may be suitably replaced; reordered, removed and additional steps may be inserted depending upon the needs of the particular application. For example, without limitation, a user may use weight 200 for practice without removing weight 200 and taking non-weighted swings immediately after. Moreover, the prescribed method steps of the foregoing embodiments may be implemented using any physical and/or hardware system that those skilled in the art will readily know is suitable in light of the foregoing teachings.

A relatively simple embodiment of the present invention comprises a weighted structure with a hole in its center for the duration of the length of the structure, a void in a section of the structure's sidewall, and a retractable device to seal the void. Some alternate embodiments of the present invention may be implemented as entire weighted clubs.

Those skilled in the art, in light of and in accordance with the teachings of the present invention, will readily recognize that some alternate embodiments may comprise a multiplicity of suitable additional components and features. For example, without limitation, lights, LEDs, counters for recording the number of swings taken, speed sensors, means for tracking the path of the swing, noise makers, etc. Some embodiments can be made in various colors and designs, and may or may not bear various images, icons and/or logos, which may or may not be of registered trademark and/or copyright status.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of providing golf club weights according to the present invention will be apparent to those skilled in the art. The invention has been described above by way of illustration, and the specific embodiments disclosed are not intended to limit the invention to the particular forms disclosed. For example, the particular implementation of the weight may vary depending upon the particular type of structure used. The weights described in the foregoing were directed to cylindrical implementations; however, similar techniques are to provided weights of various different shapes such as, but not limited to, rectangular or triangular tubes, donut shapes, spheres, cubes, etc. Non-cylindrical implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An apparatus, comprising:

a weighted structure comprising a top, a bottom, a sidewall, a central hole extending from said top to said bottom, a void having an angular shape and extending from said top to said bottom in said sidewall, a first curved cavity disposed in said top, and a second curved cavity disposed in said bottom, said central hole being configured to accept a shaft of a golf club, said void being configured to enable a length of said shaft to pass through said sidewall into said central hole;

a compressible material being joined to a wall of said central hole to contact said shaft;

a clasp comprising a surface being configured to cover said void, a face extending into said void, a first curved leg being configured to move within said first curved cavity, a second curved leg being configured to move within said second curved cavity, a first protrusion being disposed on said face to mate with a first end portion of said first curved cavity and a second protrusion disposed on said face to mate with a second end portion of said second curved cavity, said clasp being operable to rotate about said sidewall to close said void and retain said shaft within said central hole;

a first spring mechanism being disposed in said first curved cavity and being joined to said weighted structure and said first curved leg, said first spring mechanism being configured to be operable to urge said clasp to close said void; and a second spring mechanism being disposed in said second curved cavity and being joined to said weighted structure and said second curved leg, said second spring mechanism being configured to be operable to urge said clasp to close said void.

2. The apparatus as recited in claim 1, in which said weighted structure further comprises a cylindrical shape.

3. The apparatus as recited in claim 1, in which said compressible material comprises a vinyl coated foam material.

4. The apparatus as recited in claim 1, in which said clasp further comprises a third protrusion being configured to be grasped to rotate said clasp.

* * * * *